United States Patent [19]

Staples

[11] Patent Number: 4,514,603

[45] Date of Patent: Apr. 30, 1985

[54] DOOR OPERATED SWITCH ASSEMBLY

[75] Inventor: Paul R. Staples, Cub Run, Ky.

[73] Assignee: E.M.B. Corporation, Elizabethtown, Ky.

[21] Appl. No.: 581,708

[22] Filed: Feb. 21, 1984

[51] Int. Cl.[3] ..... H01H 3/16

[52] U.S. Cl. ..... 200/61.62; 200/61.76; 200/339

[58] Field of Search ..... 200/61.61, 61.62, 61.63, 200/61.64, 61.65, 61.66, 61.67, 61.68, 61.69, 61.7, 61.71, 61.72, 61.73, 61.74, 61.75, 61.76, 61.77, 61.78, 61.79, 61.8, 61.81, 61.82, 61.83, 61.84, 339

[56] References Cited

U.S. PATENT DOCUMENTS 3,694,595 9/1972 Horecky ..... 200/61.76
3,725,626 4/1973 Kruse ..... 200/295
4,314,111 2/1982 Kobayashi ..... 200/339 X

*Primary Examiner*—A. D. Pellinen
*Assistant Examiner*—Morris Ginsburg
*Attorney, Agent, or Firm*—Robert F. Meyer

[57] ABSTRACT

A plunger which opens and closes a switch is actuated by a hollow switch button which is trapped between a switch housing and a post which carries the plunger. An edge of the post bearing against the inside corner of the hollow button and the chamfered ends of the button flanges bearing against the intersection of the open end housing walls and a rim extending from the walls provide the button pivot axis to actuate the plunger. The switch includes two resilient blades one of which is longer than the other. One end of each blade is fixed with their distal ends pointed toward and overlapping each other.

9 Claims, 5 Drawing Figures

DOOR OPERATED SWITCH ASSEMBLY

BACKGROUND OF THE INVENTION

The present invention pertains to a door operated light switch that is particulary adaptable for household refrigerators or freezers.

In such applications, cleaning maintenance of the appliance often exposes the electrical light switch to cleaning solutions that are normally used to sanitize refrigerators and the like. These solutions are normally heavily ionized, thus becoming a good electrical conductor. Hand held sponges or cleaning solutions wiped over the exposed portion of the switch poses a serious shock hazard if the cleaning solution penetrates the switch and completes an electrical circuit through the hand held sponge or cloth and through the individual's body to the opposite electrical polarity. Thus it is imperative that the electrical elements of the switch, both internal and external terminals of the switch, not come into contact to the ionized cleaning solution.

PRIOR ART

In U.S. Pat. No. 3,725,626 there is described and claimed a waterproof switch in which there are two compartments, one for the switch elements and one for the switch actuating members. The present invention represents an improvement over this type of switch by providing, among other features, a switch which has a button actuator that pivots in a substantially friction-free manner and switch elements that provides very reliable contact make and break with little or no spurious arcing.

SUMMARY OF THE INVENTION

Accordingly, there is provided a door switch which in general comprises a housing having sidewalls and an open end, a post carried in the housing, a plunger carried by the post and engaging switch means carried in the housing to open and close same, and a switch button actuating the plunger carried in the open end and trapped between the post and the housing with an edge of the post providing a bearing surface against which the switch button is pivoted to actuate the plunger.

The switch elements include a pair of resilient blades, one of the blades being substantially longer than the other, each of the blades being fixed at an end having their distal ends pointing toward and overlapping each other, the plunger engaging the longer blade to selectively engage and disengage the blade from each other.

DETAILED DESCRIPTION OF THE INVENTION

Figure 1:
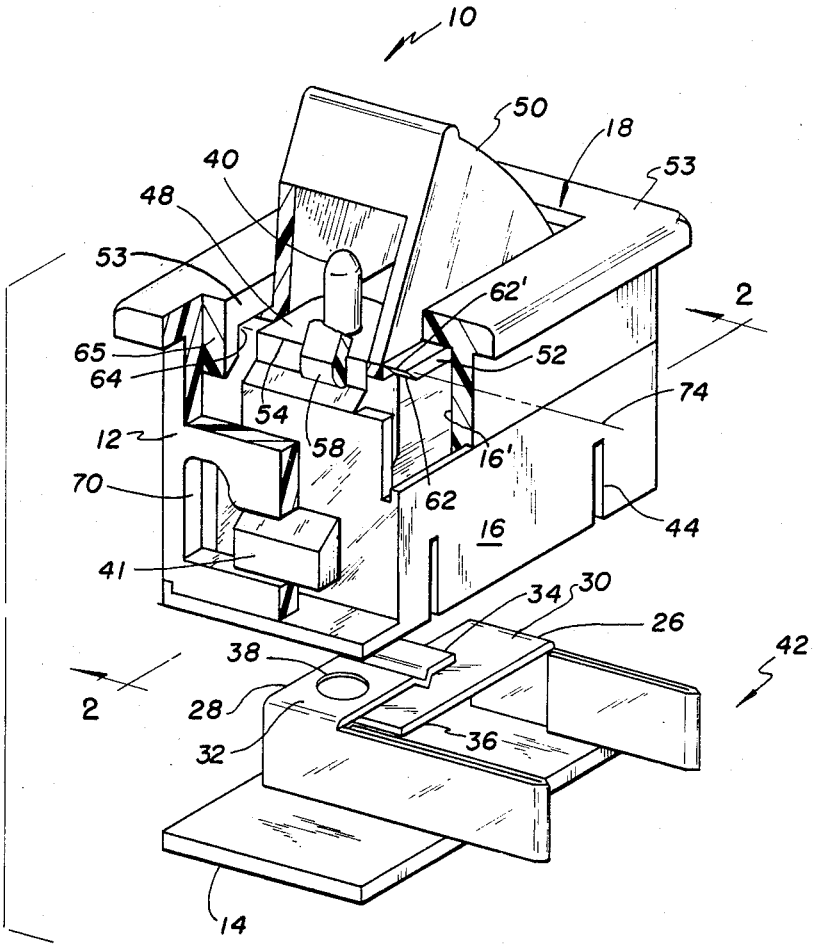
FIG. 1 is an exploded isometric view of a switch showing the features of the invention.

Referring now to the drawings, there is shown a switch 10 employing the features of the invention. The switch elements are enclosed in a housing 12 having a base 14, sidewalls 16 and an open end 18. The housing is divided into two compartments 20 and 22 by a partition 24. Compartment 20 carries the switch elements while compartment 22 carries the switch actuator member. This arrangement prevents any cleaning solutions or other fluids from contacting the switch elements.

The switch elements include resilient contact blades 26 and 28. Each of the blades is fixedly held at one end 30 and 32 with their distal ends 34 and 36 being pointed at and overlapping each other. Blade 28 includes an aperture 38 through which a plunger 40 is free to move to actuate blade 26. A pair of electrical terminals 42 (one shown) are integral with the blades and extend through notches 44 provided in sidewall 16. This arrangement, with the blades pointing toward each other, provides a "wiping stick-slip" motion which achieves very reliable electrical contact make and break. More particularly, the stick-slip wiping action prevents influences of contact film and contamination on the electrical contact action. Also, as a result of the high forces and wiping action of the electrical contact, high shear forces prevents contact welding influences on contact opening. The two resilient blades are of considerably different flexural length. The longer blade 26 deflects much more than the shorter one thus providing a substantial air gap between the blades. This prevents or substantially reduces spurious arcing.

Figure 4:
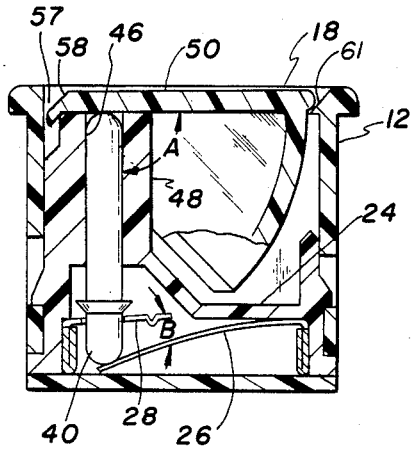
FIG. 4 is a section showing a different operating mode than that of FIG. 2.

Plunger 40 is slideably carried in a bore 46 of post 48. Post 48 is integral with and extends from partition 24. It snaps into and is held against sidewalls 16 through lugs 41 and 43. Plunger 40 is operated by switch button 50 which is pivotally carried in the open end 18 of housing 12. Button 50 is hollow to receive post 40 and includes flanges 52 on two of its sides which engages rim 53 of housing 12 to maintain the button within the housing. A flange 58 of the button is trapped between post 48 and wall 16'. The pivot axis of the button is established on edge 54 of the post. More specifically, referring to FIGS. 1, 2 and 4, the pivot axis is established by positioning the inside of the 135° angular corner formed by the inside face 56 of the button and the inside of flange 58 over the 90° angular corner 54 of the post to provide a 45° angular rotation of the button. An shown in FIG. 2, the outer surface of flange 58 is radiused 59 at its outer edge and extends into a gap 57 which in combination with the gap permits the button to be depressed without flange 58 interferring with sidewall 16'.

Figure 5:
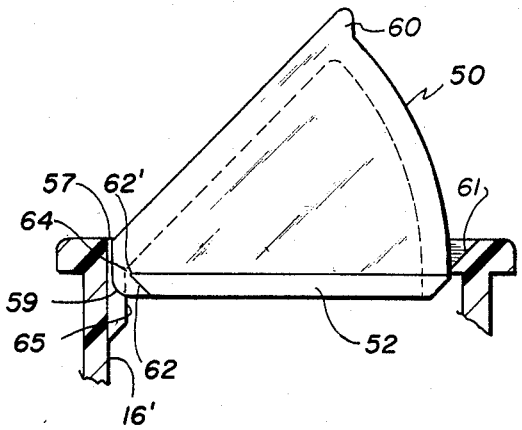
FIG. 5 is an enlarged view taken along line 5—5 of FIG. 3 showing a switch button utilized in the switch.
Figure 3:
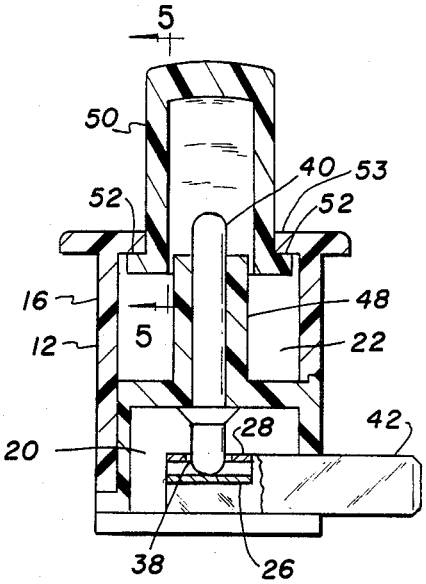
FIG. 3 is a section taken along the line 3—3 of FIG. 2.

Referring to FIGS. 1 and 5, the outer flanges 52 of the button are chamfered 45° at the end 62 that is trapped between post 48 and sidewall 16' of the housing through leg 65 which extends from rim 53. By providing the inside corner 64 of the housing 12 in line 74 with the tip 62' of the chamfer 62 and in line 74 with the 135° corner of the button and all in line with the edge 54 of post 48, a very free axis of rotation for the button is realized and its only degree of freedom is 45° of angular rotation between its inherent stops of flanges 52 against under side of rim 53 as the upstop position and downstop protrusion 60 of button 50 engaging inclined surface 61 of housing 12.

Figure 2:
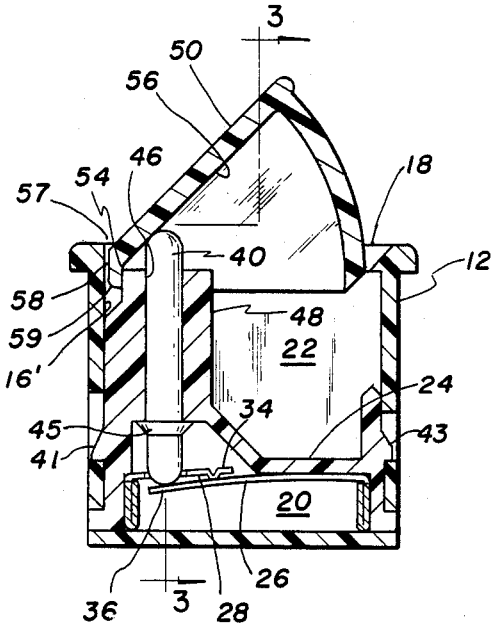
FIG. 2 is a section taken along the line 2—2 of FIG. 1.

The switch is normally mounted in the door mullion of the refrigerator. Referring to FIG. 2, when the door is closed the switch button is in the depressed position to lower plunger 40 and disengage blade 26 from blade 28 to open the switch. As shown, blade 26 is moved through an angle B which is opposed to angle A formed by plunger 40 and button 50. This angular relationship, because of the relative resiliency of blades 26 and 28, insures that blade 26 will always be in engagement with the plunger even when the plunger is in the extended position of FIG. 2. Thus button 50 is urged to its fully extended position by resilient blade 26 and the button pivoting about edge 62' of chamfer 62 engaging corner 64 formed by intersection of leg 65 with rim 53. Thus the resiliency of blade 26 provides the contact force necessary to overcome deflection of blade 28 to move button to its open or upward stop.

Referring to FIG. 2, when the door is opened, the spring action of blade 26 forces plunger 40 and button 50 outwardly to permit blade 26 to engage blade 28 to close the switch.

The switch is also provided with at least one aperture 70 to permit unwanted fluids to vent from compartment 22. More specifically, when the mullion and the button is "sponged down" unwanted gaseous fluids can enter the compartment 22 through openings around the plunger 40, for example. The gaseous fluids can then exit through the opening.

What is claimed is:

1. A door switch comprising a housing having sidewalls and an open end, a post carried in said housing, a plunger carried by said post and engaging a switch means carried in said housing to open and close same, a switch button actuating said plunger carried in said open end and trapped between said post and said housing, an edge of said post providing a pivot axis against which said switch button is pivoted to actuate said plunger.

2. A door switch according to claim 1 wherein a gap is provided between said post and said housing and said button includes a first flange extending into said gap.

3. A door switch according to claim 2 wherein said first flange is radiused at its end extending into said gap.

4. A door switch according to claim 2 wherein said button includes a second flange extending from two of its sides and engaging a rim of said housing.

5. A door switch according to claim 4 wherein said second flange includes a chamfer engaging said housing in line with said edge of said post.

6. A door switch comprising a housing having an open end, partition means dividing said housing into two compartments, switch means carried in one of said two compartments, switch actuator means carried in the other of said two compartments and extending through said partition means to actuate said switch means, said switch actuator means including a pivoting member carried in said open end and pivoted against a pivot axis provided by an edge of said partition means.

7. A door switch comprising:

(a) a housing, (b) means dividing said housing into first and second compartments, (c) a button and a plunger carried in said first compartment with said plunger extending into said second compartment, (d) a switch carried in said second compartment including a first resilient contact blade of a first length, a second resilient contact blade of a second length substantially longer than said first resilient contact blade, each of said first and second resilient contact blades fixed at an end and having the distal end of said first resilient blade overlapping said second resilient blade, an aperture in said first resilient blade, said plunger extending through said aperture to engage said second resilient blade to selectively engage and disengage same from said first resilient contact blade.

8. A door switch according to claim 7 wherein said plunger moves said second resilient blade through an angle which is opposed to an angle formed between said button and said plunger.

9. A door switch according to claim 7 wherein said plunger is carried by a post and wherein an edge of said post provides a pivot axis for said button.

* * * * *